United States Patent [19]

Friedrich

[11] Patent Number: 4,768,682

[45] Date of Patent: Sep. 6, 1988

[54] CHILD-RESISTANT DROPPER ASSEMBLY

[75] Inventor: Peter W. Friedrich, Jersey City, N.J.

[73] Assignee: The West Company, Phoenixville, Pa.

[21] Appl. No.: 112,292

[22] Filed: Oct. 26, 1987

[51] Int. Cl.[4] ..... B67B 5/00; B67D 5/32

[52] U.S. Cl. ..... 222/153; 215/222

[58] Field of Search ..... 215/2, 222; 222/153

[56] References Cited

U.S. PATENT DOCUMENTS

| | | | |
|---|---|---|---|
| 3,917,096 | 11/1975 | Hedgewick | 215/211 |
| 4,091,948 | 5/1978 | Northup | 215/222 |
| 4,444,327 | 4/1984 | Hedgewick | 215/222 |
| 4,579,238 | 4/1986 | Herr | 215/222 |

*Primary Examiner*—George T. Hall

*Attorney, Agent, or Firm*—Eugene E. Renz, Jr.

[57] ABSTRACT

A child-resistant dropper closure container combination comprising a container having a finish at its discharge end including a plurality of locking fingers spaced apart to define a series of circumferentially spaced channels and having keeper slots, a cap having an annular top and a depending skirt and a plurality of locking lugs circumferentially spaced on the interior of the skirt and a dropper assembly mounted in the cap including a flexible biasing flange engageable with the container finish and the interior of the cap to normally bias the cap in a direction to retain it in a locked position wherein the lugs engage in the keeper slots and permitting axial and rotational movement of the cap relative to the container to align the locking lugs with the channels for removal purposes.

4 Claims, 4 Drawing Sheets

FIG. 8
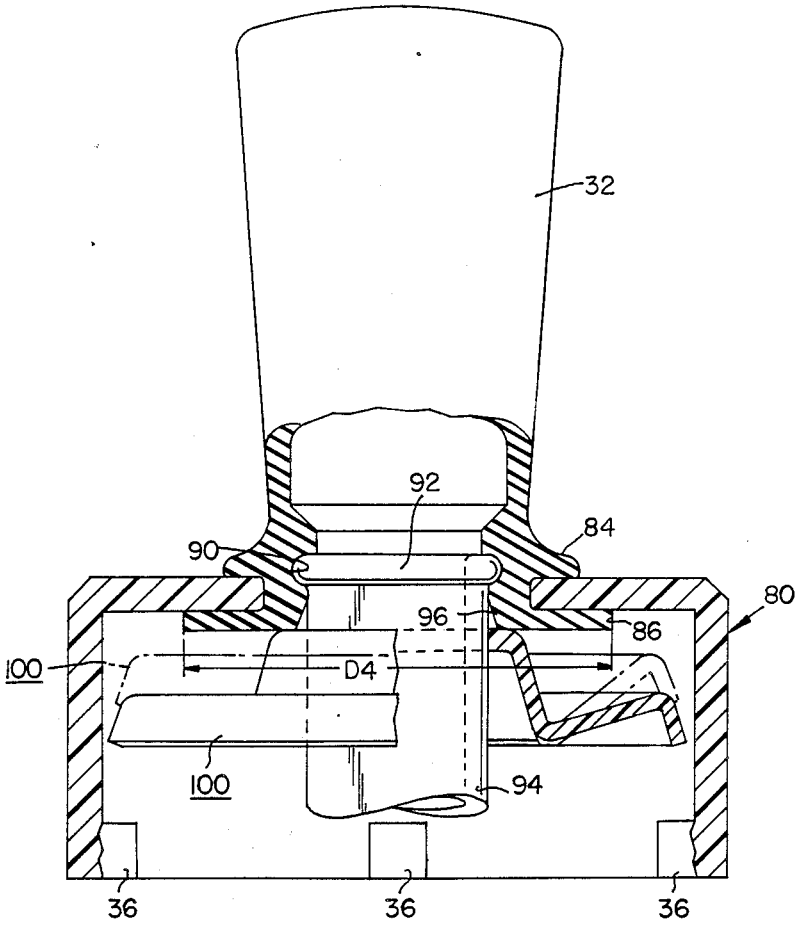
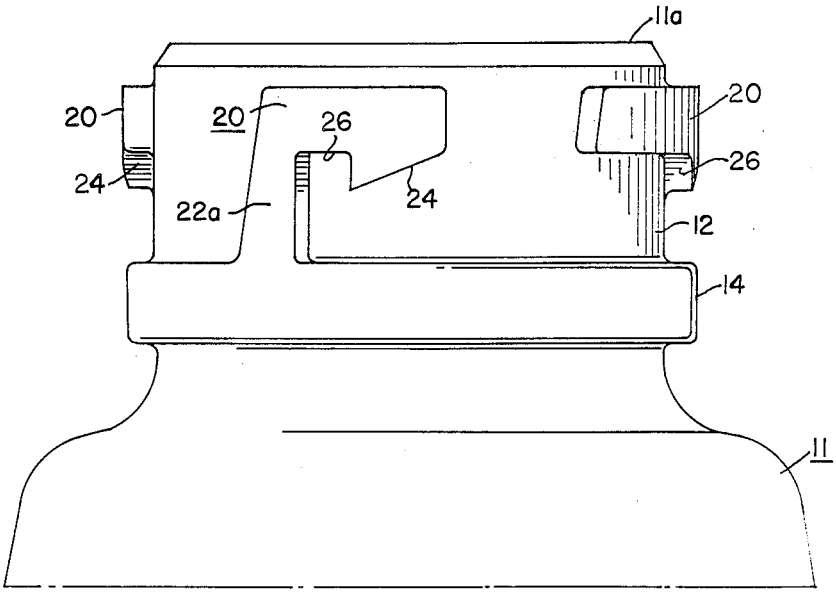
FIG. 7

CHILD-RESISTANT DROPPER ASSEMBLY

FIELD OF THE INVENTION

The present invention relates to improvements in tamper-evident closure assemblies and more specifically, to an improved push turn child-resistant dropper assembly.

BACKGROUND OF THE INVENTION

Dropper assemblies are not new per se. A typical construction is shown in Mitchell U.S. Pat. No. 3,154,116. The assembly illustrated therein comprises a blow-molded one-piece medicine dropper unit including an elongated dropper tube or barrel 10 made of a rigid material and is integrally formed with a collapsible bellows 12. The dropper is supported on the discharge end of a container such as a bottle by a cap having a radially inwardly directed flange portion in its top which engages at the lower end of the bellows. The prior art also discloses push and turn cap assemblies. See for example, Hedgewick U.S. Pat. Nos. 3,485,403 and 3,756,445 and Powers U.S. Pat. No. 3,200,979 entitled LATCHING CAP issued Aug. 17, 1965. In the assemblies illustrated, particularly the Hedgewick Patents, the cap is normally biased axially in one direction by spring means, part of which is formed integrally with the cap in Hedgewick U.S. Pat. No. 3,485,403 and is a separable element which cooperates with the cap in Hedgewick U.S. Pat. No. 3,756,445.

SUMMARY OF THE INVENTION

With the foregoing in mind, it is the object of the present invention to provide a new and improved dropper assembly incorporating novel child-resistant features which is easy and economical to manufacture and truly effective for the purposes intended. To this end, the dropper closure assembly of the present invention comprises a cap of cup-like form having a series of locking lugs on the inner wall of the skirt portion of the cap which cooperate and register with cooperating teeth circumferentially spaced about the outer periphery of the container and a dropper assembly movably mounted in a central opening in the top wall of the cap and having biasing means engagable with the top of the cap to normally urge the cap to a locked position wherein the lugs engage the keeper slot in the teeth on the container. When it is desired to release the cap and dropper assembly, the cap is simply pressed downwardly against the biasing means. The cap may then be rotated, in the present instance, in a counter-clockwise direction to a point where the lugs engage the beveled back face of the teeth wherein the lugs are aligned with a slotted opening between the teeth to permit the cap and dropper assembly to be removed. After use, the cap is simply positioned over the top of the container, pressed downwardly, rotated in the opposite direction, and released whereby the lugs re-engage in a locked position with the keeper slot in the teeth.

BRIEF DESCRIPTION OF THE DRAWINGS

These and other objects of the present invention and the various features and details of the operation and construction thereof are hereinafter more fully set forth with reference to the accompanying drawings, wherein:

FIG. 7 is an enlarged fragmentary side elevational view of a modified container finish;

FIG. 8 is a side elevational view partly in section of a modified dropper assembly in accordance with the present invention;

DETAILED DESCRIPTION OF THE PREFERRED EMBODIMENT

Figure 2:
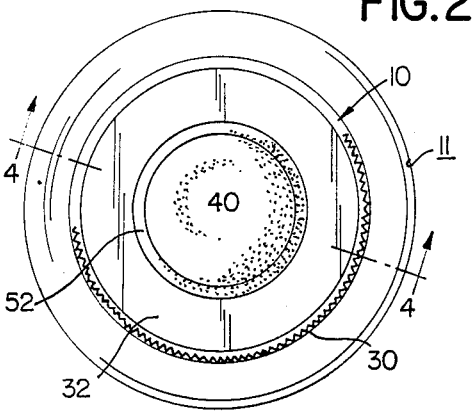
FIG. 2 is a top plan view thereof.
Figure 1:
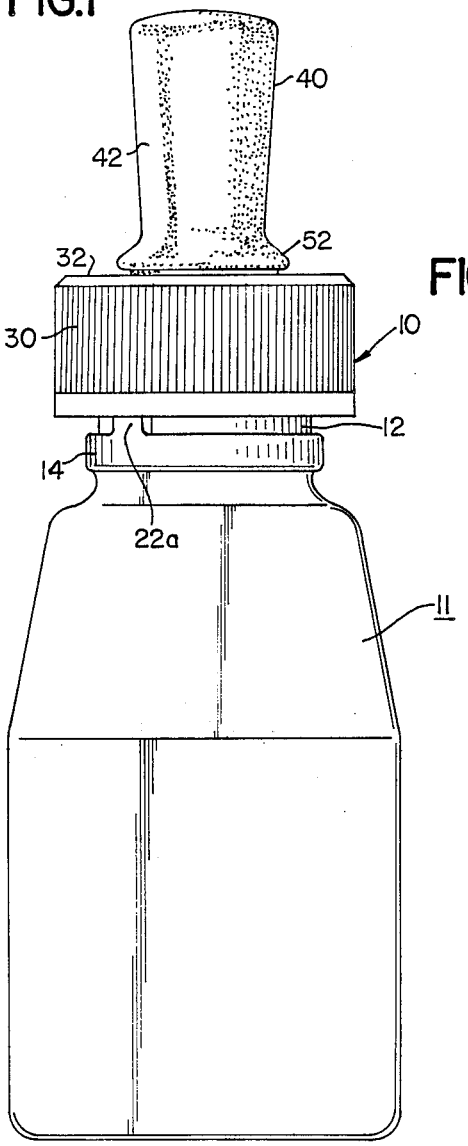
FIG. 1 is a side elevational view of a child-resistant dropper-container assembly in accordance with the present invention.
Figure 3:
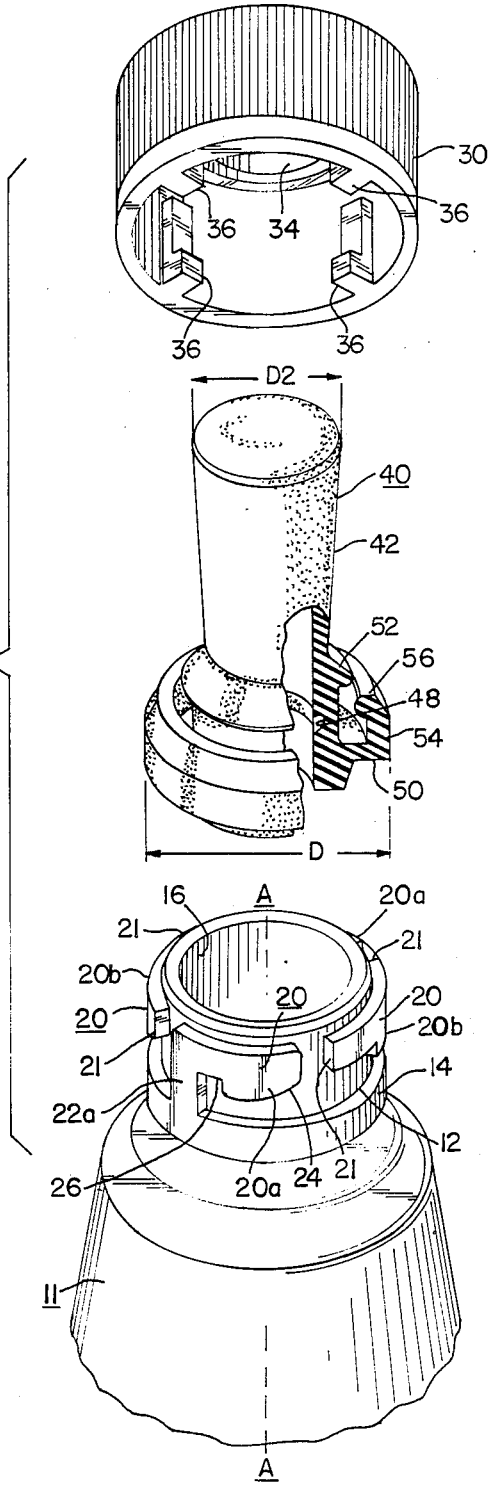
FIG. 3 is an exploded perspective view of the elements comprising the dropper assembly and the container finish.

Referring now to the drawings and particularly to FIGS. 1–3 thereof, there is illustrated one embodiment of child-resistant dropper assembly in accordance with the present invention generally designated by the numeral 10. Considering first the structural details and arrangement of the container which is generally designated by the numeral 11, the discharge end of the container or container finish 12 has a radially outwardly directed continuous flange 14 spaced downwardly from the open discharge end 16. As best illustrated in FIG. 3, the outer wall of the container finish 12 has a series of circumferentially spaced locking fingers 20.

The locking fingers 20, as illustrated, extend circumferentially and, in the present instance, comprise four in number which are spaced from one another to define four circumferentially, equi-spaced slots 21 through which the locking lugs of the cap may engage during the cap application and cap removal process described in more detail below. In the present instance, there are two diametrically opposed locking fingers identified by the numeral **20*a* and a pair of diametrically opposed locking fingers intermediate these which are labeled 20*b*. The locking fingers 20*a* have an axial leg 22*a* which, as illustrated, is angularly disposed relative to a plane through the central axis A—A of the container. These legs define an abutment surface against which the lugs of the cap engage during application and removal of the cap from the container in the manner described in more detail below. The locking fingers 20*b* do not have axial legs but may be provided with the same if desired. The lower face of each locking finger has an upwardly inclined surface 24 adjacent the locking slot or notch 26. The bottom wall of the notch 26 is spaced a predetermined distance A from the top wall 11*a* of the container and the lower edge 28 of the beveled face 24** is located a predetermined distance B from the axial end face of the container for a purpose to be described in more detail below.

Figure 4:
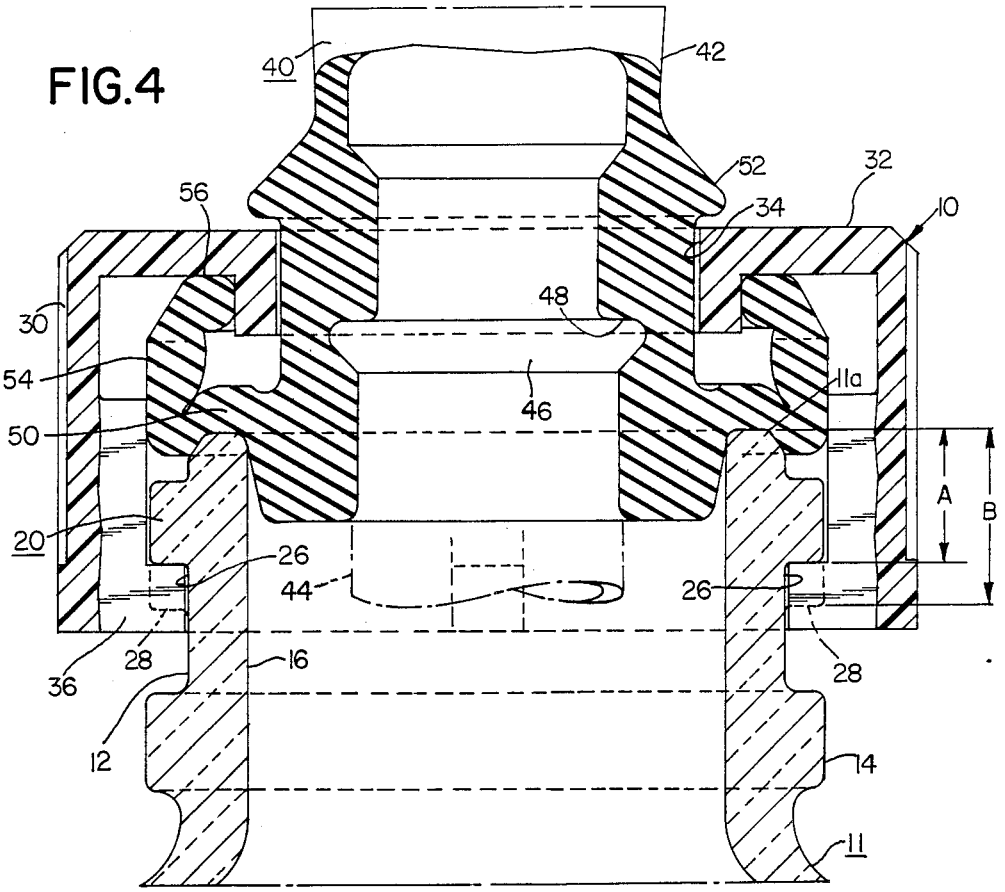
FIG. 4 is an enlarged fragmentary sectional view taken on lines 4—4 of FIG. 2.
Figure 5:
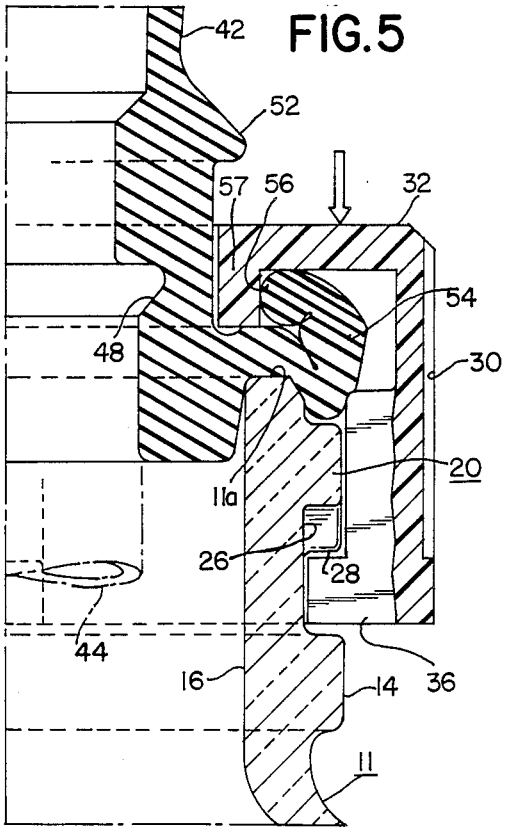
FIGS. 5 and 6 are longitudinal sectional views similar to FIG. 4 except showing the parts of the dropper assembly container in a lock position in FIG. 5 and a released position in FIG. 6.
Figure 6:
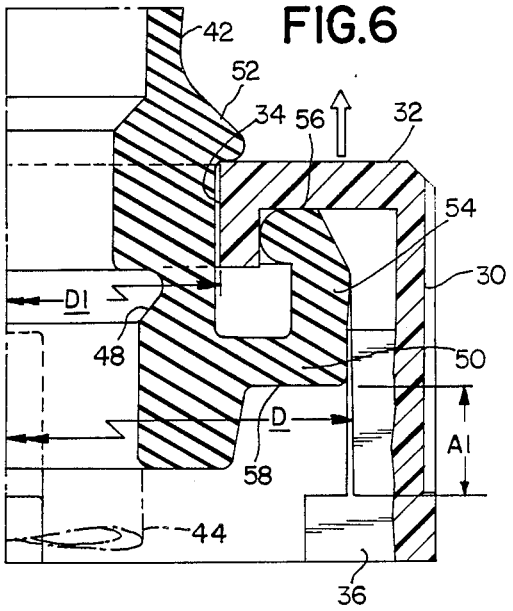

The cap, as illustrated, is of generally cup-like form and includes a circumferentially extending depending skirt 30 and an annular top 32 terminating in a central opening 34. The cap has a series of inwardly projecting circumferentially equi-spaced locking lugs 36 on the inner wall of the skirt adjacent the lower terminal edge thereof. These lugs cooperate with the locking fingers 20 on the container to lock the closure on the container in a tamper-proof manner as described in more detail below. The dropper element 40 of the cap assembly includes a bulbous element 42 made of a resilient material such as rubber or a flexible plastic, and an elongated dropper tube or barrel 44 made of a rigid material having an annular rib 46 at its upper end which engages in an internal groove 48 in the head of the bulbous element 42 to support it in the relationship shown. In the present instance, the bulb has an enlarged radially outwardly directed continuous flange 50 at its lower terminal edge of a predetermined diameter D substantially greater than the diameter D1 of the opening 34 in the top of the cap and a relatively small flexible flange 52 spaced axially from the first flange 50. In the present instance, the lower flange 50 has an upstanding ring 54 with a slightly inwardly beveled upper edge 56 projecting from the outer peripheral edge thereof which normally engages and confronts the inner face of the top of the cap in the manner shown in FIG. 4. In the relaxed state, the bottom face 58 of the lower flange 50 is spaced from the upper edge of the locking lugs by a predetermined distance A1. (see FIG. 6)

The parts comprising the dropper-closure assembly are easy to put together. For example, the elongated tube is simply pressed into the bulbous element 42 until the rib 46 seats in the internal groove 48 adjacent the short upper flange. Note that the bore of the bulb is beveled at the entrance end to facilitate assembly of the tube member. The bulb/tube subassembly is then inserted through the opening 34 in the top of the cap from the inside, the opening 34 in the cap being of a diameter D1 slightly larger than the diameter D2 of the bulb 42 to permit assembly of the bulb through the top opening (see FIGS. 3 and 6). Note that the short flange 52 is flexible enough to pass through the opening 34 and once pulled through will automatically seat against the top face of the annular portion by reason of the upstanding ring which presses against the inner face of the annular portion of the top to normally position the parts in the relationship shown in FIG. 6.

Considering now the use and operation of the child-resistant dropper assembly described above, the cap is simply positioned over the container so that the lugs 36 register with the gaps between the locking fingers and press downwardly against the bias of the upstanding ring. The cap is then rotated in a clockwise direction until the lugs butt the inner edge of the axial leg of the fingers. The cap is then released whereby the ring will displace the cap upwardly so that the lugs engage in the keeper slot of the fingers in a locked position. In this position, the lugs lock the cap against rotational movement relative to the container and thus, any attempts to open the cap by simply turning it, which is the normal inclination of children, will not result in removal of the cap. Now when it is desired to remove the cap, the cap is simply pushed axially downwardly against the bias of the ring to a point where the lugs clear the tip of the catch. The cap is now rotated counter-clockwise until the lugs engage the angled back face of the fingers. The cap can now be released and the spring ring will urge the cap upwardly. In this position, the lugs are aligned with the gaps or channels 21 between the fingers and thus, the cap and dropper assembly can be removed.

There is illustrated in FIGS. 7 and 8, another embodiment of dropper/closure assembly in accordance with the present invention generally designated by the numeral 80. The cap and bottle finish are generally similar to that described previously in the description of the principal embodiment shown in FIGS. 1–6 inclusive and accordingly, are assigned the same reference numerals. However, in the present instance, the dropper assembly is of a modified configuration and as best illustrated, includes a bulbous element 82 terminating at its lower end in a pair of radially outwardly directed axially spaced flanges 84 and 86 which are spaced apart a distance to straddle and snuggly engage the annular portion of the top of the cap in the manner shown. Note that the lower flange 86 is of a slightly greater diameter D4 than the diameter of the shorter upper flange 84. The interior of the bulb adjacent the base is provided with a groove 90 to receive the rib 92 of the barrel for tube 94. The lower entrance end to the hollow, bulbous element is tapered as at 96 to define a pilot for ease of inserting and assembling the tube 94. In the present instance, a biasing member 100 is provided which engages the upper edge of the locking teeth at its outer periphery and closely circumscribes the dropper assembly. The biasing element is made of a resilient flexible material, such as rubber, and is a dish-like element having a Z-shaped cross-section. When the cap is applied to the container finish, the generally horizontal web portion of the dish-shaped biasing element engages the top ledge or surface 11*a* of the container neck and is compressed or displaced to the broken line position illustrated in FIG. 8. This provides a biasing action securely retaining the locking lugs 36 in the keeper slots 26 when the cap is in a locked position. When it is desired to use the dropper assembly and dispense product therefrom, the cap is simply pressed downwardly so the locking lugs clear the locking slots and the cap is rotated to a position where the locking lugs 36 align with the channels between the locking fingers and the lugs engage the side edge of the axial legs of the locking fingers. In this position, the cap may be withdrawn axially for use of the dropper assembly.

Figure 9:
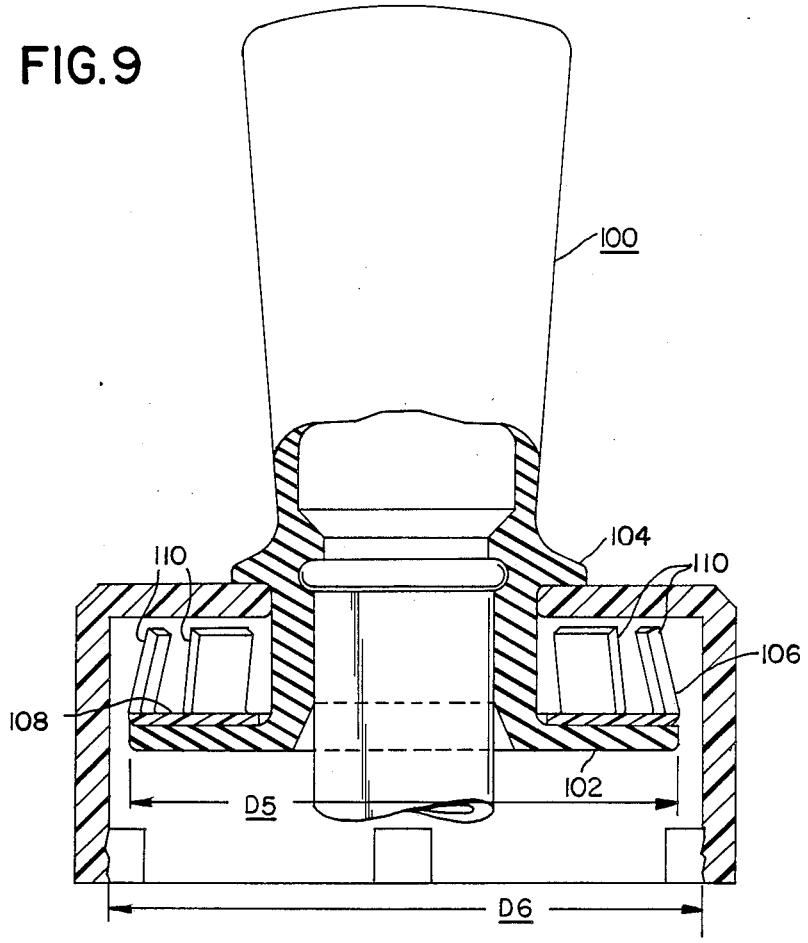
FIGS. 9 and 10 are side elevational views partly in sections similar to FIG. 8 showing further modifications of a dropper assembly in accordance with the present invention.

There is shown in FIG. 9 a further embodiment of dropper/closure assembly for use on containers having a bottle finish generally similar to that shown and described previously. In the present instance, the bulbous member 100 has a lower radially outwardly directed circumferentially extending flange 102 of a relatively large diameter D5 somewhat less than the internal diameter D6 of the cap and spaced a predetermined axial distance below a short radially outwardly extending flange 104 which confronts and engages the top of the cap in the assembled position shown in FIG. 9. A biasing element 106 made of a resilient material such as rubber or plastic comprising an annular disk 108 having upstanding circumferentially-spaced fingers 110 which are bent slightly inwardly rests on the lower flange 102 of the bulbous element. The tip of the spring fingers confront the inner face of the cap to normally bias the cap to an upper locked position. When it is desired to release the cap from the container, the cap is simply pressed axially downwardly against the bias of the spring fingers, rotated to a position where the locking lugs align with the release grooves, and then the cap and bulbous member may be removed in the manner described above.

Figure 10:
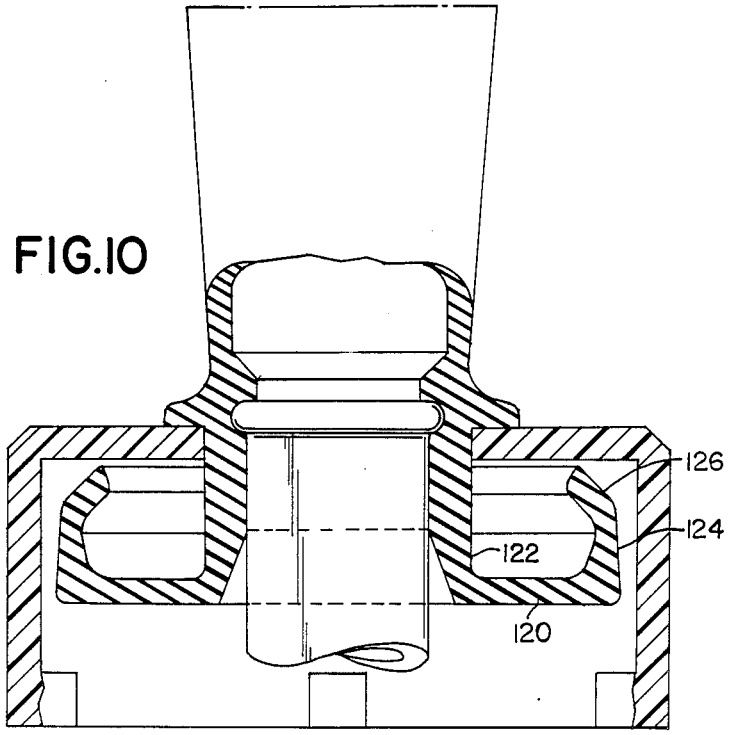

FIG. 10 shows a version of a bulbous member generally similar to that described in the principal embodiment. However, in this instance, the lower flange 120 projects from the lower terminal edge of the axial lower stem 122 of the bulbous element and the outer circumferentially extending spring lip 124 has an inwardly directed offset portion 126 to provide the biasing action described in the previous embodiments when it is desired to remove the cap and dropper assembly from a container on which it is locked.

While particular embodiments of the present invention have been illustrated and described herein, it is not intended to limit the invention and changes and modifications may be made therein within the scope of the following claims.

What is claimed is:

1. A child-resistant dropper closure container combination comprising a container having a finish at its discharge end including a plurality of locking fingers spaced apart to define a series of circumferentially spaced channels and having keeper slots, a cap having an annular top and a depending skirt and a plurality of locking lugs circumferentially spaced on the interior of the skirt and a dropper assembly mounted in the cap including a flexible biasing flange engageable with the container finish and the interior of the cap to normally bias the cap in a direction to retain it in a locked position wherein the lugs engage in the keeper slots and permitting axial and rotational movement of the cap relative to the container to align the locking lugs with the channels for removal purposes.

2. A combination as claimed in claim 1, wherein said biasing means is formed integrally with the bulbous member and has a radially directed circumferentially extending flange terminating in an axially inwardly bent lip.

3. A combination as claimed in claim 1, wherein said bulbous member includes a pair of flanges spaced axially apart and an angular member seated on one of the flanges interiorly of the cap having circumferentially spaced locking fingers extending upwardly from the outer edge of the disk at an inwardly directed angle.

4. A combination as claimed in claim 1, wherein said biasing means includes a Z-shaped element engageable at its inner edge with the lower terminal end of the bulbous element and at its outer periphery is engageable with the top of the container when the cap is applied to the container.

* * * * *